United States Patent [19]

Janssen et al.

[11] Patent Number: 4,900,406

[45] Date of Patent: Feb. 13, 1990

[54] METHOD OF ELECTROLYTIC METAL COATING OF A STRIP-SHAPE METAL SUBSTRATE AND APPARATUS FOR CARRYING OUT THE METHOD

[75] Inventors: Leonard J. J. Janssen, Nuenen; Gijsbertus C. Van Haastrecht, Heemskerk, both of Netherlands

[73] Assignee: Hoogovens Groep B.V., Ijmuiden, Netherlands

[21] Appl. No.: 364,169

[22] Filed: Jun. 12, 1989

[30] Foreign Application Priority Data

Jun. 14, 1988 [NL] Netherlands ..... 8801511

[51] Int. Cl.[4] ..... C25D 7/06; C25D 17/00

[52] U.S. Cl. ..... 204/28; 204/206

[58] Field of Search ..... 204/28, 206

[56] References Cited

U.S. PATENT DOCUMENTS 3,669,852 6/1972 Winters ..... 204/46

OTHER PUBLICATIONS

Chemical Abstracts, Vol. 104, No. 4, (1986), page 172, No. 22301s, Cook, "Using Fuel Cells or Anode Depolarization to Reduce Electrowinning Energy Consumption".

*Primary Examiner*—T. M. Tufariello

*Attorney, Agent, or Firm*—Stevens, Davis, Miller & Mosher

[57] ABSTRACT

In the electrolytic metal coating of a strip-shape metal substrate, the substrate is passed in a continuous process as cathode through an electrolytic coating apparatus having an insoluble anode, the cathode and anode being connected to an external voltage source so that metal ions are deposited onto the substrate from an acidic electrolyte between the cathode and anode. To increase the anode service life and reduce power consumption, a hydrogen-providing gas, e.g. molecular hydrogen, is fed to the anode and a catalyst is available at the anode, so that under the influence of the catalyst electrons and hydrogen ions are formed from said hydrogen-providing gas, the hydrogen ions passing into the electrolyte.

11 Claims, 2 Drawing Sheets

METHOD OF ELECTROLYTIC METAL COATING OF A STRIP-SHAPE METAL SUBSTRATE AND APPARATUS FOR CARRYING OUT THE METHOD

BACKGROUND OF THE INVENTION

1. FIELD OF THE INVENTION

The invention relates to a method of electrolytic metal coating of a strip-shape metal substrate and to apparatus for carrying out the method.

2. DESCRIPTION OF THE PRIOR ART

EP-A No. 268823 describes electrolytic coating of metal strip in which the substrate is conveyed in a continuous process as cathode through an electrolytic coating apparatus of a type with an insoluble anode. Cathode and anode are connected to an external voltage source, so that metal ions are deposited onto the substrate from an acidic electrolyte between cathode and anode to form the desired plated coating.

In the following description the invention will be described mainly as applied to electrotinning of steel. However, the invention may equally be used for coating a metal substrate other than steel and for coating a metal substrate with a metal coating other than tin.

In the classical process of tinplating of steel, a soluble anode is used of the same metal as the coating to be formed, that is to say tin. This tin anode, is consumed during the coating process because the tin anode goes into solution in the electrolyte according to the electrochemical reaction:

$$Sn \rightarrow Sn^{2+} + 2e^- \quad (1).$$

A coating of tin is deposited from the electrolyte onto the cathode, that is to say the cold rolled steel strip, according to the electrochemical reaction:

$$Sn^{2+} + 2e^- \rightarrow Sn \quad (2).$$

This classical tinplating method has various disadvantages of which the most important mentioned here is that, during the process, because the tin anode goes into solution, the distance between anode and cathode varies and as a result the tin coating thickness on the cathode is uneven.

In order to prevent these disadvantages, it is known, from for example EP-A No. 268823, to use an insoluble anode instead of the tin anode. A coating of tin is deposited onto the cathode from the electrolyte according to the same electrochemical reaction (2) as in the classical process. The following electrochemical reaction takes place on the anode:

$$2H_2O \rightarrow 4H^+ + 4e^- + O_2 \quad (3).$$

The oxygen formed escapes. Water is consumed overall, the $H^+$-concentration in the electrolyte increases and the $Sn^{2+}$-concentration decreases. In a continuous process these changes are compensated for in a separate tin dissolving apparatus.

A disadvantage of this known process with an insoluble anode and an acid electrolyte is that the technical service life of the anode, which may consist of for example iridium oxide ($IrO_2$) on titanium or of platinum on titanium, is very limited.

U.S. Pat. No. 3669852 described removal of dissolved oxygen during electroplating of gold from citrate and phosphate buffered gold cyanide plating baths by means of nitrogen gas or a chemical reducing agent such as hydrazine or sulphite ions. Chemical Abstracts vol. 104, 1986, no. 22301 mentions use of H to decrease energy consumption in electrowinning and in fuel cells, by anode depolarization. See below for a further discussion of use of hydrogen in fuel cells.

SUMMARY OF THE INVENTION

The object of the invention is to provide a method of electrolytic metal coating in a continuous process in which the disadvantage described is removed or is reduced in particularly so that a longer service life of the insoluble anode is obtained.

In the invention a gas providing hydrogen is fed to the anode, so that under the influence of a catalyst, essentially according to the electrochemical reaction:

$$H_2 \rightarrow 2H^+ + 2e^- \quad (4)$$

electrons and hydrogen atoms are formed. The hydrogen ions are absorbed into the electrolyte.

Preferably, the gas providing hydrogen is fed to the anode on the anode side facing away from the cathode, a porous anode is used, the gas in the pore passages of the porous anode is brought into contact with the electrolyte, and the anode electrochemical reaction takes place on the boundary surface of gas, the electrolyte and the anode, to form electrons and hydrogen ions from the gas. A coating is deposited on the cathode from the electrolyte according to an electrochemical reaction which is the same as that in the known method, e.g. in tinplating according to reaction (2) above. As in the prior art process using an insoluble anode, the loss of metal ions from the electrolyte may be compensated for by addition of fresh ions from a separate source.

An advantage obtainable with the invention is that the insoluble anode has a longer service life. The probable cause for this is that, in the electrochemical reaction (4) which occurs in the method in accordance with the invention in contrast to the electrochemical reaction (3) which occurs in the known process with an insoluble anode, no oxygen is formed. By way of illustration, reaction (3) takes place at an anode potential of over 1.0 volt (relative to the potential of a saturated calomel electrode (SCE)); on the other hand the reaction (4) takes place at a considerably lower anode potential, namely over −0.24 volts relative to SCE. Taking into account the difference in activation polarization for reactions (3) and (4), the difference in anode potential at a current density of 1 $kA/m^2$ and a temperature of 50° C. is approximately 1.6 volts. Because of this, with the method in accordance with the invention, reaction (3) does not take place, or practically does not, and no oxygen, or hardly any is formed.

Moreover, the ohmic voltage drop in the electrolyte solution with an anode at which oxygen gas bubbles are developed according to reaction (3) is approximately 0.1 volt higher than with an anode at which hydrogen is consumed according to reaction (4).

Other advantages obtainable with the invention are:

1. Because of the lower anode potential and the lower ohmic voltage drop in the solution, the voltage difference between anode and cathode is considerably lower and so the energy consumption is considerably lower too.

2. In the known method with an insoluble anode, oxidation occurs from Sn to $Sn^{4+}$ making a sludge form in the electrolyte. This causes tin loss or the sludge has to be extracted separately. Because as stated before with the method in accordance with the invention, no oxygen is developed at the anode, oxidation to $Sn^{4+}$does not occur or hardly occurs.

3. In electrolytic coating processes use is nearly always made of a polishing agent (mixture of organic substances). The use of polishing agents is nearly always necessary for obtaining coatings of the desired properties. In the known method with an insoluble anode, oxidation of the polishing agent occurs at the anode where oxygen is developed. Also hydrogen peroxide forms at the cathode so that the organic substances or oxidized there as well. These oxidations of the polishing agent do not occur with the method in accordance with the invention in which no oxygen is developed.

4. An improvement in the stability of the electrolyte.

5. An improvement in the quality of the coating.

Given that the hydrogen ions formed combine with water, the electrochemical reaction (4) may also be described as $$H_2 + 2H_2O \rightarrow 2H_3O^+ + 2e^- \quad (4a)$$

Within the framework of the invention reactions (4) and (4*a*) are identical.

It is noted that it is known to use a gas diffusion anode in phosphoric acid fuel cells. Concentrated phosphoric acid is used in these fuel cells as electrolyte. These fuel cells are operated at a temperature of approximately 200° C. because of the boiling point of phosphoric acid. Gas containing hydrogen is fed to the anode and reaction (4) occurs. The gas diffusion anode is porous and the reaction (4) occurs at the boundary surface of gas containing hydrogen, electrolyte and anode. However, the use of this gas diffusion anode as component of an electrolytic coating process is not known. Such use may be thought improbable because the fuel cell produces electrical energy, while anode and cathode in the electrolytic coating process are connected to a voltage source and electrical energy is consumed. In the phosphoric acid fuel cell the electrolyte consists of concentrated phosphoric acid and the electrolyte does not contain any metal ions which are deposited onto the cathode. In the coating process the electrolyte is a dilute acidic, aqueous solution of for example 100 g/l, maximum 500 g/l, sulphuric acid, phenol sulphonic acid (PSA) or chromic acid and the electrolyte contains metal ions which are deposited onto the cathode. The process temperature in the coating process is dictated by the electrochemical reaction and is preferably no higher than 80° C.

So, although the electrolyte used in the electrolyte coating process differs in kind, concentration, degree of acidity and electrical conductivity from that in the phosphoric acid fuel cell and furthermore, the process conditions such as current density of the anode and the temperature of the electrolyte are not the same as with the phosphoric acid fuel cell, in the present invention it is preferred to use an anode such as has been developed for the phosphoric acid fuel cell, in which as catalyst a noble metal (such as platinum), an oxide form of noble metal (such as ruthenium oxide) or an alloy of a noble metal is used. A small quantity of another metal may be added to the catalyst. Preferably the catalyst is used in a divided state together with a porous carbon anode.

Within the present invention, a hydrogenproviding gas hydrogen may be a gas that consists essentially of molecular hydrogen gas, a mixture of gases includes molecular hydrogen or a gas (or mixture) that contains a compound of hydrogen, such as natural gas, capable of providing hydrogen ions in the process. However, preference is given to a gas that consists essentially of hydrogen gas. In the other cases mentioned, by-products such as another gas or a reaction product of natural gas are fed into the electrolyte with possibly disadvantageous consequences for the electrolytic coating.

An important industrial use of the coating process in accordance with the invention is the coating of cold rolled strip steel with tin, chromium (so-called ECCS =Electrolytic Chromium/chromium oxide Coated Steel), zinc, an iron/zinc alloy or a zinc/nickel alloy.

BRIEF INTRODUCTION OF THE DRAWINGS

The invention will be illustrated by way of non-limitative example with reference to the accompanying drawings, in which.

DESCRIPTION OF THE PREFERRED EMBODIMENTS

Figure 1:
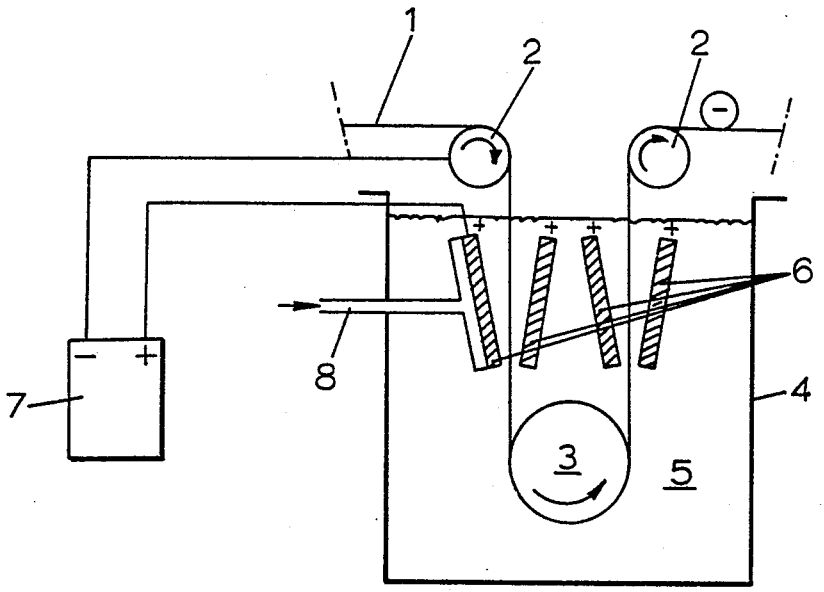
FIG. 1 shows an apparatus embodying the invention for electrolytic coating of metal strip.

FIG. 1 shows a strip-shaped metal subtrate 1 conveyed continuously through a tank 4 containing electrolyte 5 and four gas-diffusion anodes 6 by means of exterior rollers 2 and an immersed return roller 3. An external voltage source 7 is connected to the anodes 6 and to the strip 1 via the rollers 2. In the tank 4 a coating is deposited electrolytically onto the strip 1 as the strip 1 as cathode passes between the opposed pairs of anodes 6.

A gas containing hydrogen is fed to each of the anodes 6 via a conduit pipe 8 to the anode side facing away from the cathode strip 1. This pipe 8 is shown only for the leftmost anode is FIG. 1 but a similar pipe is provided for each anode 6.

The apparatus shown in FIG. 1 has flat anodes, but the invention may use apparatus of a radial type such as shown in EP-A No. 268823.

Figure 3:
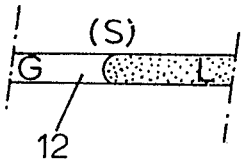
FIG. 3 shows an enlarged section of the three phase boundary surface.
Figure 2:
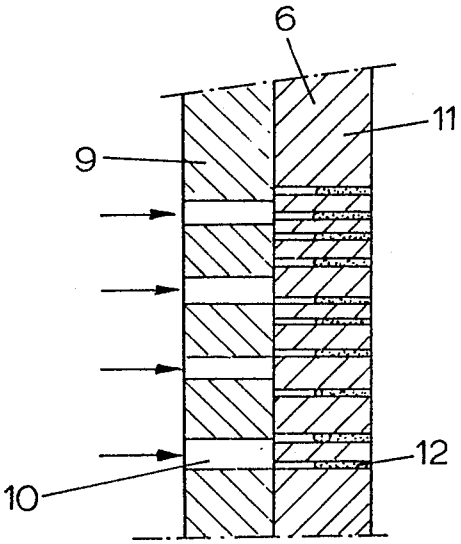
FIG. 2 shows details of a gas diffusion anode used in the apparatus of FIG. 1.

FIG. 2 shows details of one of the gas diffusion anodes 6. The anode 6 has a hydrophobic part 9 at its side away from the cathode 1 with coarse pores 10 into which the gas containing hydrogen in fed and a hydrophilic part 11 with fine pores 12 on the electrolyte side. The electrochemical reaction in 4 takes place in the fine pores at the three phase boundary surface of the gas containing hydrogen (G)/electrolyte (L)/and solid anode material (S) (see FIG. 3). $H^+$ions are formed at this boundary surface. The anode consists of platinum as catalyst applied onto porous carbon.

EXAMPLE

In this example, the invention is applied to the tinplating of cold-rolled steel strip, using apparatus as shown in FIGS. 1 and 2. With a strip width of 1000 mm and strip speed of 5 m/s, a coating thickness of 2.8 g/m$^2$ Sn was plated, using a Ferrostan electrolyte (containing $Sn^{2+}$) with a pH of about 1 and an $H_2$ feed rate to the anode of 1.6 kg/hour. The anode was porous graphite and the catalyst on it was Pt. Addition of $Sn^{2+}$ions was carried out to maintain the electrolyte. Current density and applied voltage were selected in the range 20–30

A/dm$^2$ and 10–20 V respectively to achieve this result, and the anode/cathode gap was 2–5 cm. Typically, in such a process the strip width is 800–1200 mm, the strip speed 4–7 m/s and the coating thickness 1–11.2 g/m$^2$ Sn. Current density and voltage ranges are given above.

What is claimed is:

1. Method of electrolytic metal coating of a strip-shape metal substrate, comprising the steps of (a) passing the substrate in a continuous process as cathode through an electrolytic coating apparatus having an insoluble anode, a catalyst at the anode, and an acidic electrolyte between the anode and the substrate, (b) applying a voltage to the anode and the substrate as cathode so that metal ions are electrolytically deposited from the electrolyte onto the substrate to form the coating, (c) supplying to the anode a hydrogen-providing gas so that, in the electrolytic process, under the influence of said catalyst electrons and hydrogen ions are formed at the anode from the hydrogenproviding gas, the hydrogen ions passing into the electrolyte.

2. Method according to claim 1 wherein said hydrogen-providing gas is selected from molecular hydrogen and gaseous compounds of hydrogen capable of catalytic reaction at the anode to give electrons and hydrogen ions, the reaction at the anode in the case of molecular hydrogen being essentially $$H_2 \rightarrow 2H^+ + 2e^-.$$

3. Method according to claim 2 wherein said anode is porous and has a first face contacting the electrolyte and facing the substrate as cathode, a second face facing away from the substrate as cathode and pore passages leading through it from said second face to said first face, and wherein said hydrogen-providing gas is supplied to said second face and passes through said pore passages to make contact with the electrolyte, whereby the electrochemical process takes place at the boundary surface of the gas, the electrolyte and the anode to form the electrons and the hydrogen ions.

4. Method according to claim 1 wherein the temperature of the electrolyte is not more than 80° C.

5. Method according to claim 1 wherein the electrolyte is a dilute acidic aqueous solution.

6. Method according to claim 1 wherein the catalyst is selected from the group comprising noble metals, oxides of noble metals and alloys of noble metals.

7. Method according to claim 1 wherein the anode is of porous carbon and the catalyst is in a finely divided state on the anode.

8. Method according to claim 1 wherein the hydrogen-providing gas is essentially molecular hydrogen.

9. Method according to claim 1 wherein the substrate is cold-rolled steel strip.

10. Method according to claim 1 wherein the metal of the metal coating is selected from tin, chromium, zinc, an iron/zinc alloy and a zinc/nickel alloy.

11. Apparatus for the electrolytic metal coating of a strip-shape metal substrate, comprising an insoluble anode, means for moving a strip-shape metal substrate as cathode past the anode so that said anode and cathode provide a space between them for electrolyte, means for applying a voltage to said anode and cathode, means for feeding a hydrogen-providing gas to said anode and catalyst material at said anode for formation of electrons and hydrogen ions from said gas during electrolysis.

* * * * *